US008857536B2

(12) United States Patent
Brennenstuhl et al.

(10) Patent No.: US 8,857,536 B2
(45) Date of Patent: Oct. 14, 2014

(54) HAND-HELD POWER TOOL

(75) Inventors: Jens Brennenstuhl, Albershausen (DE); Ralf Windsheimer, Stuttgart (DE); Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 568 days.

(21) Appl. No.: 12/951,759

(22) Filed: Nov. 22, 2010

(65) Prior Publication Data

US 2011/0139478 A1 Jun. 16, 2011

(30) Foreign Application Priority Data

Dec. 15, 2009 (DE) ..... 10 2009 054 636

(51) Int. Cl.
*B27F 5/00* (2006.01)
*B25B 21/00* (2006.01)
*B25F 5/02* (2006.01)

(52) U.S. Cl.
CPC .. *B25F 5/02* (2013.01); *B25B 21/00* (2013.01)
USPC ..... 173/216; 173/104; 173/178; 173/213; 173/217; 81/57.39; 81/469; 475/266

(58) Field of Classification Search
USPC ..... 173/217, 216, 104, 176, 178, 48, 93, 173/213; 81/467, 469, 59.1, 57.39; 475/258, 265, 266, 342
See application file for complete search history.

(56) References Cited

U.S. PATENT DOCUMENTS

| | | | | |
|---|---|---|---|---|
| 3,739,659 | A * | 6/1973 | Workman, Jr. | 475/266 |
| 3,768,577 | A * | 10/1973 | Leoni | 173/93 |
| 3,791,149 | A * | 2/1974 | Strecker et al. | 60/543 |
| 4,026,116 | A * | 5/1977 | Purcupile et al. | 405/259.1 |
| 4,121,745 | A * | 10/1978 | Smith et al. | 227/8 |
| 4,558,747 | A * | 12/1985 | Cunningham | 173/55 |
| 4,609,053 | A * | 9/1986 | Ragnmark | 173/104 |
| 4,619,162 | A * | 10/1986 | Van Laere | 81/464 |
| 4,625,903 | A * | 12/1986 | Becht | 227/131 |
| 4,721,170 | A * | 1/1988 | Rees | 173/13 |
| 4,892,013 | A * | 1/1990 | Satoh | 475/266 |
| 4,898,249 | A * | 2/1990 | Ohmori | 173/176 |
| 5,076,120 | A * | 12/1991 | Lin | 81/54 |
| 5,897,454 | A * | 4/1999 | Cannaliato | 475/265 |
| 6,009,775 | A * | 1/2000 | Thompson et al. | 81/54 |
| 6,093,128 | A * | 7/2000 | Seith | 475/258 |
| 6,099,433 | A * | 8/2000 | Brouwer | 475/342 |
| 6,196,332 | B1 * | 3/2001 | Albert et al. | 173/176 |
| 6,298,753 | B1 | 10/2001 | Izumisawa | |
| 6,523,442 | B2 * | 2/2003 | Lehnert et al. | 81/467 |
| 7,066,691 | B2 * | 6/2006 | Doyle et al. | 408/124 |
| 7,357,195 | B2 * | 4/2008 | Kamimura et al. | 173/216 |
| 7,604,528 | B2 * | 10/2009 | Lo et al. | 451/354 |

FOREIGN PATENT DOCUMENTS

| | | | |
|---|---|---|---|
| GB | 382530 | A | 10/1932 |
| GB | 401545 | A | 11/1933 |

* cited by examiner

*Primary Examiner* — Scott A. Smith
(74) *Attorney, Agent, or Firm* — Kenyon & Kenyon LLP

(57) ABSTRACT

The invention describes a hand-held power tool having a drive train, which includes a motor with a rotor, a drive shaft, and a transmission. According to the invention, at least one flywheel mass is provided that is positionable rotationally symmetrical to the drive shaft and connectable to the drive shaft for co-rotation therewith.

24 Claims, 5 Drawing Sheets

HAND-HELD POWER TOOL

CROSS-REFERENCE TO RELATED APPLICATION

This application is based on German Patent Application 10 2009 054 636.7 filed on Dec. 12, 2009.

BACKGROUND OF THE INVENTION

Field of the Invention

The invention relates to a hand-held power tool.

In order to satisfy the requirements of ever more compact and lighter-weight designs of cordless screwdrivers, cordless drills, and cordless impact drill/drivers, the drive train, composed of a serial arrangement of a motor, transmission, and tool holder, must be shortened in overall length and reduced in weight. The shortened and weight-reduced design, however, should not result in a reduction in the mechanical output power of the hand-held power tool. Instead, the output power should be increased as much as possible, despite its compact design.

A compact design of a hand-held power tool can be achieved, for example, through the use of a motor with a shorter and lighter-weight design. Such a motor, however, has the disadvantage of a significantly reduced mass moment of inertia. When the hand-held power tool is used for work tasks that are heavy influenced by dynamic effects, e.g. hard or soft screwdriving tasks, this can become clearly perceptible through a significant drop in achievable torques.

SUMMARY AND ADVANTAGES OF THE INVENTION

The invention is based on a hand-held power tool with a drive train that includes a motor with a rotor, a drive shaft, and a transmission. The drive shaft can, for example, be the armature shaft or a shaft of the drive train that is coupled to the armature shaft for co-rotation therewith. In particular, the drive shaft rotates at the same speed as the armature shaft.

According to the invention, the hand-held power tool has at least one flywheel mass that can be arranged so that it is rotationally symmetrical to the drive shaft and can be connected to the drive shaft for co-rotation therewith. The flywheel mass advantageously achieves an increase in the mass moment of inertia so that with the use of power-condensed motors in compact hand-held power tools such as cordless screwdrivers and cordless drills, it is possible to achieve values of kinetic energy comparable to those achieved with conventional motors. Due to the co-rotational coupling of the flywheel mass to the drive shaft, the flywheel mass rotates with the high speed of the motor, thus exerting its greatest effect. The rotationally symmetrical arrangement of the flywheel mass in relation to the drive shaft advantageously prevents an imbalance from being produced.

A flywheel mass that has a certain, slight deviation from an ideal rotational symmetry is also considered to be a flywheel mass with a rotationally symmetrical geometry. The deviation from an ideal rotational symmetry can, for example, be manufacture-induced in that a flywheel mass is manufactured by means of sintering and as a result, has density variations. A deviation from the ideal rotational symmetry can also arise from the fact that the flywheel mass is provided with means to compensate for an imbalance. The flywheel mass is in particular constituted by an additional component that is provided in addition to the rotating components of the motor such as the rotor, armature shaft, and possibly commutator, and the rotating components of the transmission in the drive train of the hand-held power tool. The flywheel mass functions as a mass in addition to the components that are usually situated on the drive shaft in a hand-held power tool. In addition, the flywheel mass is in particular connected to the drive shaft for co-rotation therewith in such a way that a user of the hand-held power tool is not able to replace or remove the flywheel mass.

The flywheel mass is preferably composed of metal and is made, for example, of zinc, iron, steel, brass, or bronze. It can be manufactured, for example, by means of sintering.

In an advantageous embodiment, the flywheel mass has an external diameter that is greater than the external diameter of the rotor. This makes it possible to provide a flywheel mass with a larger outer diameter, which has the advantage that the thickness of the flywheel mass can be kept comparatively low. In comparison to a flywheel mass that has essentially the same outer diameter as the rotor, the thickness of the flywheel mass is reduced while its mass remains the same. Therefore despite the presence of the flywheel mass, the overall length of the drive train is not increased or is only increased by an insignificant amount. A compact design of the hand-held power tool is therefore nevertheless possible.

In one embodiment of the invention, the motor has a motor housing and the flywheel mass is situated outside the motor housing. Once again, this has the advantage that the outer diameter of the flywheel mass can be selected independently of the diameter of the rotor or motor housing. In particular, the outer diameter of the flywheel mass is not limited by the inner diameter of the motor housing. Another advantage lies in the fact that a conventional motor of the type usually used in hand-held power tools can be used in the hand-held power tool according to the invention, without requiring any adaptations. It is thus possible to still install a conventional motor as a ready-made component in the hand-held power tool according to the invention. Different types of motors such as DC motors, AC motors, and brushless motors or brush-equipped motors can be used in the hand-held power tool according to the invention. The invention is not limited to a particular motor type.

As an alternative to a motor with a motor housing, it is also possible for a motor with the so-called open-frame design without a motor housing to be used in the hand-held power tool according to the invention. Once again this has the advantage that the outer diameter of the flywheel mass is not limited by the outer diameter of the rotor or the diameter of the motor housing. The outer diameter of the flywheel mass can be selected so that the thickness of the flywheel mass is minimal.

In one embodiment of the invention, the transmission has a transmission housing and the flywheel mass is situated inside the transmission housing. This can be advantageously used so that components of the transmission, e.g. a ring gear or planetary gears of a planetary gear set, and/or components of the transmission housing, e.g. a housing cover, perform the function of axially securing the flywheel mass relative to drive shaft. In addition, during operation of the hand-held power tool according to the invention, a wobbling motion of the flywheel mass can occur, which is limited by components of the transmission and/or transmission housing situated in front of and behind the flywheel mass in the axial direction.

The transmission can be a one-stage or multi-stage transmission. For example, the transmission is a planetary gear set of the type known from the prior art.

To connect the flywheel mass to the drive shaft, in particular a means for a form-locked connection, a means for a frictional, nonpositive connection, or a combination of the two means is provided. In particular, the means produce a radial securing of the flywheel mass and can also perform the additional function of axially securing the flywheel mass. In a simple embodiment, the flywheel mass is radially and axially secured directly to the drive shaft in a frictional, nonpositive fashion, e.g. by means of a press-fitted connection. For a form-locked connection, the drive shaft can be flattened in one or more regions and in this case, the flywheel mass is provided with a central opening that corresponds to the flattened drive shaft. The drive shaft and the central opening can, for example, have a square cross-section.

In one embodiment of the invention, the flywheel mass is connected directly to the drive shaft for co-rotation therewith. In the context of the present invention, a direct connection of the flywheel mass to the drive shaft exists when the drive shaft is connected to the flywheel mass without interposed components. For this purpose, the flywheel mass has a centered opening for accommodating the drive shaft. In a simple embodiment, the direct connection is produced in that the flywheel mass is press-fitted directly onto the drive shaft. Alternatively, the direct connection of the flywheel mass to the drive shaft can also be produced with means for producing a form-locked connection, for example in that the drive shaft and the central opening of the flywheel mass are flattened in one or more regions so that the flattened regions of the flywheel mass correspond to the flattened regions of the drive shaft. The drive shaft and the central opening of the flywheel mass can, for example, have a square cross-section.

In an alternative embodiment of the invention, the flywheel mass is indirectly connected to the drive shaft for co-rotation therewith. In this case, the drive shaft is only indirectly connected to the flywheel mass in that at least one additional connecting element is connected between the drive shaft and flywheel mass. Such an additional connecting element can, for example, be a component of the motor or transmission that is coupled to the drive shaft for co-rotation therewith. The flywheel mass and the connecting element can be embodied either as separate components that can be connected to each other for co-rotation or as a combined component that is mounted on the drive shaft for co-rotation therewith.

In a preferred embodiment, an indirect connection of the drive shaft to the flywheel mass is produced by means of a pinion on the drive shaft. The pinion is in turn coupled to the drive shaft for co-rotation therewith. It is in particular press-fitted onto the drive shaft. Alternatively, the pinion can be connected to the drive shaft in a form-locked fashion for co-rotation therewith. For this purpose, the drive shaft and the central opening of the pinion are preferably flattened in one or more regions and the flattened regions of the drive shaft correspond to the flattened regions of the central opening of the pinion. The drive shaft and the central opening of the pinion can, for example, have a square cross-section.

In this embodiment, the flywheel mass and the pinion constitute a co-rotational connection that secures the flywheel mass at least radially on the drive shaft. The co-rotational connection can be produced by means of a form-locked connection. Thus in one embodiment of the invention, the flywheel mass has a central internal gearing that engages with the teeth of the pinion. In this case, the flywheel mass can be slid onto the pinion. The central internal gearing of the flywheel mass enables a clean centering of the flywheel mass on the drive shaft, or more precisely stated, on the pinion, consequently permitting a low-vibration rotation of the flywheel mass.

In an alternative embodiment, the pinion and the flywheel mass comprise a combined component in that the pinion and flywheel mass are embodied of one piece with each other. This is particularly advantageous since this makes it possible to significantly reduce wobbling movements of the flywheel mass.

The pinion on the drive shaft preferably simultaneously constitutes a component of the transmission. For example, the transmission of the hand-held power tool according to the invention can be a planetary gear set and the pinion can constitute the sun gear. If the flywheel mass is coupled to the pinion for co-rotation therewith, an element that is present anyway in conventional hand-held power tools, i.e. the pinion, is additionally used to produce the co-rotational coupling with the flywheel mass. As a result, in spite of the additionally installed flywheel mass, it is possible to achieve a compact, in particular short design of the hand-held power tool since producing the co-rotational coupling of the flywheel mass does not require the provision of any devices in addition to that which are usually present in a hand-held power tool anyway.

Preferably, the flywheel mass is embodied as disk-shaped. A disk-shaped flywheel mass is advantageous because it is rotationally symmetrical to the drive shaft and therefore does not produce any imbalance. The disk-shaped flywheel mass has a round cross-section. It is provided with a centered opening for accommodating the drive shaft or for accommodating a connecting element mounted on the drive shaft for co-rotation therewith.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
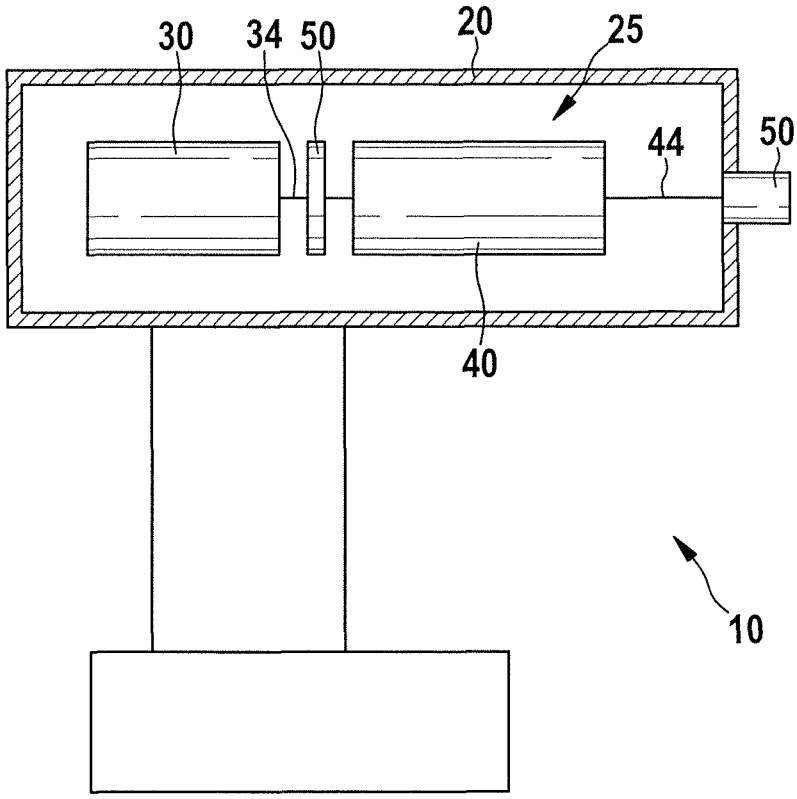
FIG. 1 is a schematic depiction of a hand-held power tool according to the invention.

FIG. 1 is a schematic depiction of a hand-held power tool 10 according to the invention, equipped with a housing 20. The drive train 25 includes a motor 30, a transmission 40, and a flywheel mass 50. The motor 30 includes a rotor 32 (see FIG. 2) and an armature shaft that functions as a drive shaft 34. The drive train 25 also includes a tool holder 60 for holding insert tools such as augurs, screwdriver bits, and drill bits. The tool holder 60 is coupled to the motor 30 via the transmission 40 and an output shaft 44.

According to the invention, the hand-held power tool 10 has at least one flywheel mass 50 that is situated rotationally symmetrical to the drive shaft 34 and is mounted on the drive shaft 34 for co-rotation therewith so that the flywheel mass 50 rotates at the same speed as the drive shaft 34. According to FIG. 1, the flywheel mass 50 is connected between the motor 30 and the transmission 40. Alternatively, the flywheel mass could also be situated after the motor 30, viewed in the working direction, i.e. at the end of the drive train 25 oriented away from the tool holder 60, provided that the flywheel mass 50 is mounted on the drive shaft 34 (not shown).

In one embodiment of the invention, the motor 30 is provided with a motor housing 36. In this case, the motor housing 36 is situated inside the housing 20 of the hand-held power tool 10. Alternatively, the motor 30 can also be embodied with the open-frame design in which the motor 30 has no separate motor housing. In this case, the motor components, among others the rotor 32, are supported without an additional housing inside the housing 20 of the hand-held power tool 10. These two embodiments, i.e. a motor 30 with a motor housing 36 and one without a housing, are schematically indicated in FIG. 2 in that the housing 36 is depicted with dashed lines.

Figure 2:
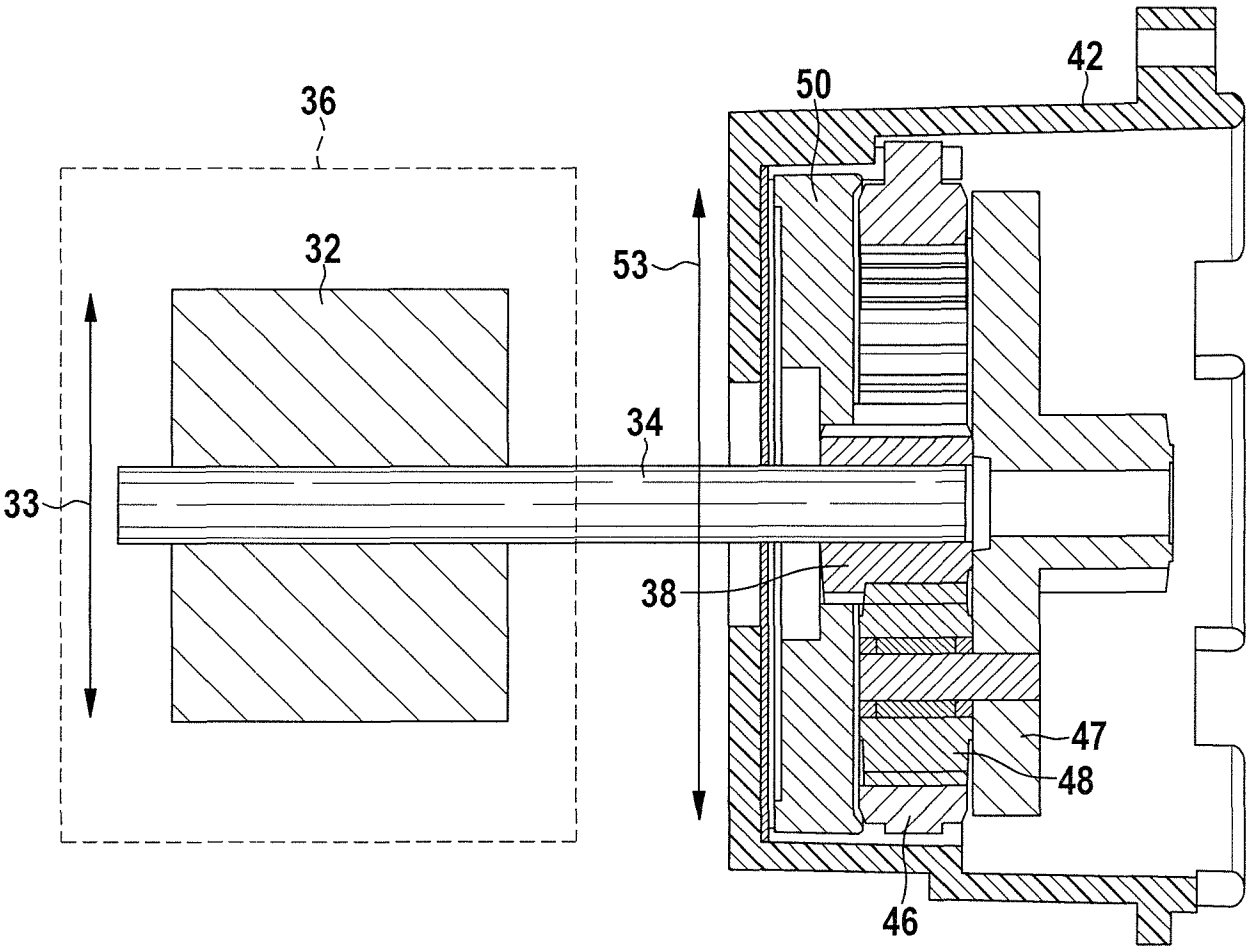
FIG. 2 shows a detail of a hand-held power tool according to the invention.

The outer diameter of the flywheel mass 50 is indicated by the arrow labeled 53 in FIG. 2. The outer diameter of the flywheel mass 50 it advantageously greater than the outer diameter of the rotor 32, which is indicated with the arrow labeled 33 in FIG. 2. With a flywheel mass 50 that has the greatest possible outer diameter, it is possible to select a comparatively low thickness of the flywheel mass 50 in order to achieve the desired mass moment of inertia. Therefore the installation of a separate flywheel mass 50 does not increase the overall length required or only increases it by an insignificant amount.

In an embodiment of the invention in which the motor 30 has a motor housing 36, the flywheel mass 50 is preferably situated outside the motor housing 36. This makes it possible to select an outer diameter of the flywheel mass 50 that is as great as possible. As can be inferred from FIG. 2, it is particularly preferable for the flywheel mass 50 to be situated inside a transmission housing 42. As a result, one element of the transmission housing 42 is situated in front of the flywheel mass 50 and at least one element of the transmission 40 is situated after it, viewed in the working direction.

Figure 3:
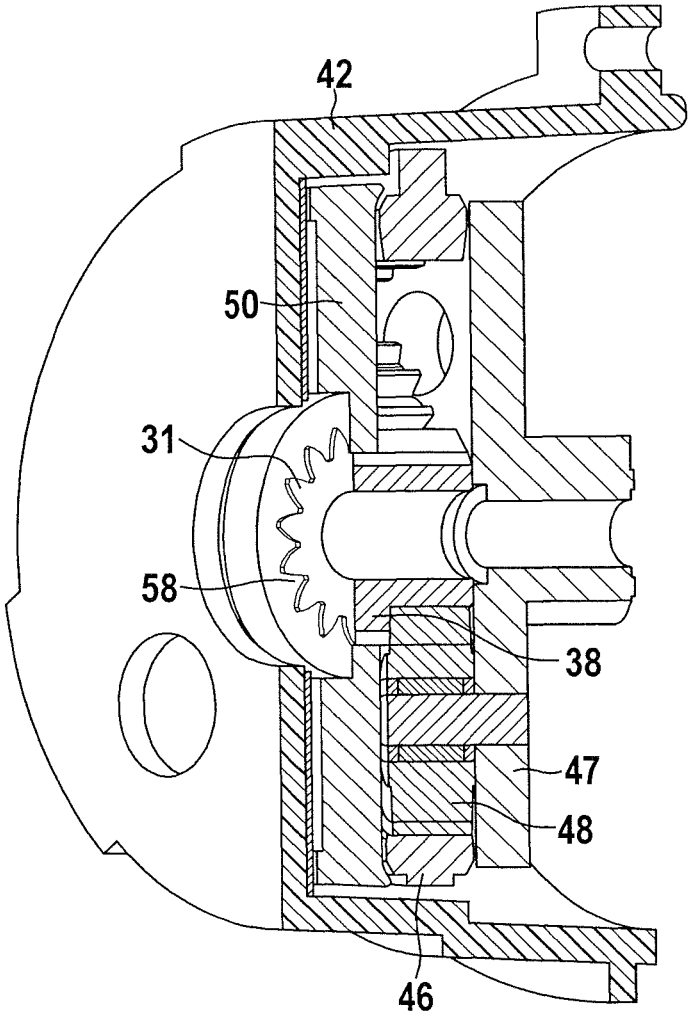
FIG. 3 is a perspective depiction of a detail from FIG. 2.

In a preferred embodiment of the invention, the flywheel mass 50 according to FIG. 2 is indirectly connected to the drive shaft 34 for co-rotation therewith. For this purpose, a connecting element in the form of a pinion 38 is connected between the drive shaft 34 and the flywheel mass 50. The pinion 38 is mounted onto the drive shaft 34 for co-rotation therewith by being press-fitted onto it. The flywheel mass 50 in turn forms a co-rotational connection with the pinion 38 and thus rotates at the same speed as the drive shaft 34. For this purpose, the flywheel mass is provided with a central internal gearing 58 that is coupled to the gearing 31 of the pinion 38 (FIG. 3). The internal gearing 58 and the pinion 38 function as a means for connecting the flywheel mass 50 to the drive shaft 34 in a form-locked fashion. In the embodiment according to FIG. 2, the pinion 38 on the drive shaft 34 simultaneously constitutes a component of the transmission 40. The transmission according to FIG. 2 is a planetary gear set and the pinion 38 constitutes the sun gear. Other elements of the planetary gear set such as the ring gear 46, the planet carrier 47, and the planetary gears 48 are depicted in FIGS. 2 and 3.

The perspective, sectional view according to FIG. 3 also shows a particularly preferred embodiment in which the flywheel mass 50 is embodied in the form of a disk. It has a round cross-section and is essentially embodied as a flat cylinder.

Figure 4:
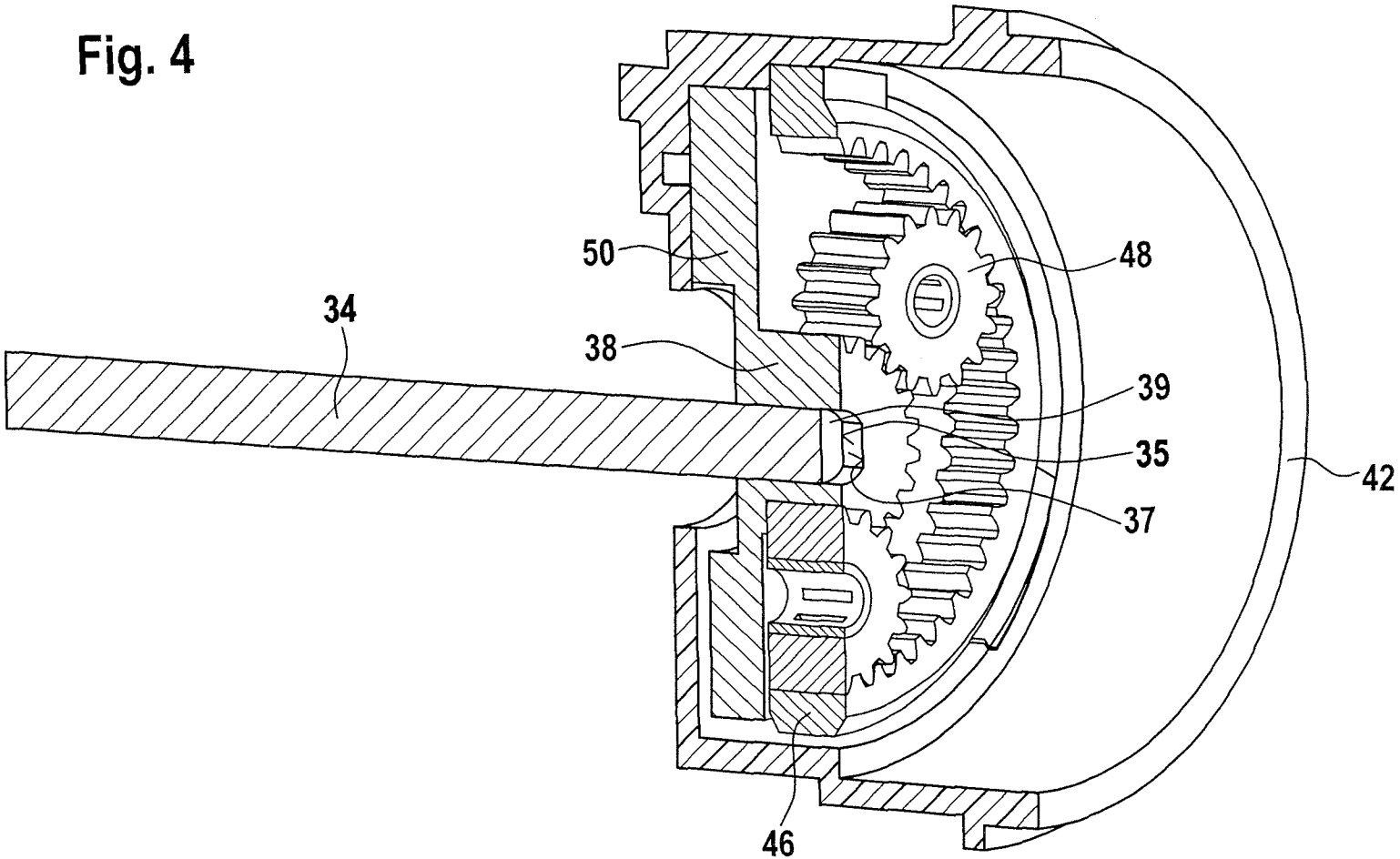
FIG. 4 is a perspective depiction of a detail from an alternative embodiment of a hand-held power tool according to the invention.

FIG. 4 represents an embodiment alternative to the embodiment shown in FIG. 3. Parts that are the same have been provided with the same reference numerals. By contrast with the embodiment in FIG. 3, according to FIG. 4, the flywheel mass 50 and the pinion 38 are embodied of one piece so that the flywheel mass 50 and pinion 38 constitute a combined component that is mounted on the drive shaft 34 for co-rotation therewith. Means for providing a form-locked connection, which are provided on the drive shaft 34 on the one hand and a central opening 39 of the pinion 38 on the other hand, produce the co-rotational coupling of the combined component composed of the flywheel mass 50 and the pinion 38. These means for providing a form-locked connection are constituted by two respective flattened regions provided both on the drive shaft 34 and in the central opening 39. The flattened regions of the drive shaft 34 are labeled with the reference numeral 35 and the flattened regions of the opening 39 are labeled with the reference numeral 37. In the sectional depiction according to FIG. 4, only one respective flattened region 35, 37 is visible. The drive shaft 34 and the central opening 39 of the pinion in this case have a square cross-section.

Figure 5:
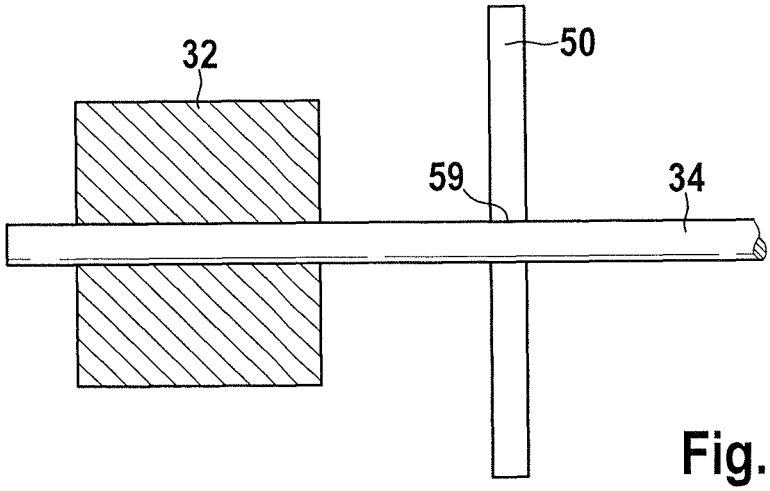
FIG. 5 is a schematic depiction of an alternative embodiment.

FIG. 5 shows a schematic detail of an alternative embodiment for connecting the flywheel mass 50 to the drive shaft 34 for co-rotation therewith. By contrast with the embodiment according to FIG. 2, on the one hand, the flywheel mass 50 in this case is co-rotationally mounted on the drive shaft 34 directly, i.e. without interposed components, in that the flywheel mass 50 is equipped with a central opening 59 for accommodating the drive shaft 34. On the other hand, the flywheel mass 50 is connected to the drive shaft 34 in a frictional, nonpositive fashion, in particular by being press-fitted onto it.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool comprising:

a drive train, which includes a motor with a rotor, a drive shaft, and a transmission embodied as a planetary gear set; and at least one flywheel mass that is arranged substantially rotationally symmetrical to the drive shaft and connectable to the drive shaft for co-rotation therewith, wherein the flywheel mass is disk-shaped and indirectly connected to the drive shaft by a connecting element, the connecting element being embodied as a pinion on the drive shaft, wherein the pinion acts as a sun gear of the planetary gear set and the flywheel mass forms a co-rotational connection with the pinion.

2. The hand-held power tool as recited in claim 1, wherein the flywheel mass has an outer diameter that is greater than an outer diameter of the rotor.

3. The hand-held power tool as recited in claim 2, wherein the motor has a motor housing and the flywheel mass is situated outside the motor housing.

4. The hand-held power tool as recited in claim 3, wherein the transmission has a transmission housing and the flywheel mass is situated inside the transmission housing.

5. The hand-held power tool as recited in claim 2, wherein the transmission has a transmission housing and the flywheel mass is situated inside the transmission housing.

6. The hand-held power tool as recited in claim 1, wherein the motor has a motor housing and the flywheel mass is situated outside the motor housing.

7. The hand-held power tool as recited in claim 6, wherein the transmission has a transmission housing and the flywheel mass is situated inside the transmission housing.

8. The hand-held power tool as recited in claim 1, wherein the transmission has a transmission housing and the flywheel mass is situated inside the transmission housing.

9. The hand-held power tool as recited in claim 1, wherein the flywheel mass has a central internal gearing which is configured to engage with teeth of the pinion.

10. The hand-held power tool as defined in claim 1, wherein the pinion is mounted onto the drive shaft by being press-fitted onto the drive shaft.

11. The hand-held power tool as defined in claim 1, wherein the planetary gear set includes planetary gears which are in meshing connection with the pinion and are disposed adjacent to the flywheel mass.

12. The hand-held power tool as defined in claim 1, wherein the flywheel mass has an outer diameter that is substantially the same as an outer diameter of a ring gear of the planetary gear set.

13. The hand-held power tool as defined in claim 1, wherein the planetary gear set includes planetary gears which are in meshing connection with the pinion and are disposed adjacent to the flywheel mass.

14. The hand-held power tool as defined in claim 1, wherein the flywheel mass has an outer diameter that is substantially the same as an outer diameter of a ring gear of the planetary gear set.

15. A hand-held power tool comprising:

a drive train, which includes a motor with a rotor, a drive shaft, and a transmission embodied as a planetary gear set; and at least one flywheel mass that is arranged substantially rotationally symmetrically relative to the drive shaft and connectable to the drive shaft for co-rotation therewith;

wherein the flywheel mass is disk-shaped and indirectly connected to the drive shaft by a connecting element, the connecting element being embodied as a pinion on the drive shaft, wherein the pinion acts as a sun gear of the planetary gear set and the flywheel mass and the pinion are embodied as one piece with each other.

16. The hand-held power tool as recited in claim 15, wherein the flywheel mass has an outer diameter that is greater than an outer diameter of the rotor.

17. The hand-held power tool as recited in claim 16, wherein the motor has a motor housing and the flywheel mass is situated outside the motor housing.

18. The hand-held power tool as recited in claim 17, wherein the transmission has a transmission housing and the flywheel mass is situated inside the transmission housing.

19. The hand-held power tool as recited in claim 16, wherein the transmission has a transmission housing and the flywheel mass is situated inside the transmission housing.

20. The hand-held power tool as recited in claim 15, wherein the motor has a motor housing and the flywheel mass is situated outside the motor housing.

21. The hand-held power tool as recited in claim 20, wherein the transmission has a transmission housing and the flywheel mass is situated inside the transmission housing.

22. The hand-held power tool as recited in claim 15, wherein the transmission has a transmission housing and the flywheel mass is situated inside the transmission housing.

23. The hand-held power tool as recited in claim 15, wherein the one piece is mounted on the drive shaft by means for providing a form-locked connection which are provided on the drive shaft and on a central opening of the pinion.

24. A hand-held power tool comprising:

a drive train, which includes a motor with a rotor, a drive shaft, and a transmission; and at least one flywheel mass that is arranged substantially rotationally symmetrical to the drive shaft and connectable to the drive shaft for co-rotation therewith, wherein the flywheel mass is indirectly connected to the drive shaft by a connecting element, the connecting element being a component of the transmission, wherein the motor has a motor housing and the connecting element is situated outside the motor housing, wherein the transmission has a transmission housing and the flywheel mass is situated inside the transmission housing, and wherein the flywheel mass is separated from the motor housing by at least one element of the transmission housing.

* * * * *